US011025037B2

(12) United States Patent
Dorsch et al.

(10) Patent No.: US 11,025,037 B2
(45) Date of Patent: Jun. 1, 2021

(54) ARRESTER FOR PROTECTION AGAINST OVERVOLTAGES

(71) Applicant: TDK Electronics AG, Munich (DE)

(72) Inventors: Eduard Dorsch, Dallgow (DE); Frank Werner, Berlin (DE); Yu Zhang, Xiaogan (CN); Jiangnan Tan, Xiaogan (CN)

(73) Assignee: TDK ELECTRONICS AG, Munich (DE)

( * ) Notice: Subject to any disclaimer, the term of this patent is extended or adjusted under 35 U.S.C. 154(b) by 0 days.

(21) Appl. No.: 16/626,230

(22) PCT Filed: May 8, 2018

(86) PCT No.: PCT/EP2018/061833

§ 371 (c)(1),
(2) Date: Dec. 23, 2019

(87) PCT Pub. No.: WO2019/007566

PCT Pub. Date: Jan. 10, 2019

(65) Prior Publication Data

US 2020/0127443 A1 Apr. 23, 2020

(30) Foreign Application Priority Data

Jul. 5, 2017 (DE) ..... 102017115030.7

(51) Int. Cl.

| | |
|---|---|
| ***H01T 1/22*** | (2006.01) |
| ***H01T 4/10*** | (2006.01) |
| ***H01T 4/04*** | (2006.01) |

(52) U.S. Cl.
CPC ..... *H01T 4/10* (2013.01); *H01T 1/22* (2013.01); *H01T 4/04* (2013.01)

(58) Field of Classification Search
CPC .... H01T 4/12; H01T 4/04; H01T 4/06; H01T 4/10; H01T 4/14; H01T 4/08; H01T 4/02; H01T 4/16; H01T 1/14; H01T 1/20; H01T 1/02; H01T 1/22; H01T 15/00; H01T 21/00; H01T 2/00; H01T 2/02
See application file for complete search history.

(56) References Cited

U.S. PATENT DOCUMENTS 3,649,874 A * 3/1972 Peche ..... H01T 13/58 361/120
2018/0298873 A1* 10/2018 Ikeda ..... H01T 2/02

FOREIGN PATENT DOCUMENTS

CH 649176 A5 4/1985
DE 1016354 B 9/1957
(Continued)

*Primary Examiner* — Bryan R Perez
(74) *Attorney, Agent, or Firm* — Slater Matsil, LLP

(57) ABSTRACT

An arrester such as an arrester for protection against overvoltages is disclosed. In an embodiment an arrester includes a housing configured to act as an external electrode, a central electrode arranged completely within an inner region of the housing, a discharge region arranged between the central electrode and the housing, a ceramic body separating the housing and the central electrode, wherein the ceramic body is arranged in an offset manner relative to the discharge region and a shielding element arranged on an inside of the housing, and wherein the shielding element extends over an entire longitudinal extent of the central electrode along the inside of the housing.

15 Claims, 3 Drawing Sheets

(56) References Cited

FOREIGN PATENT DOCUMENTS

| | | | |
|---|---|---|---|
| DE | 1944564 | A1 | 3/1971 |
| DE | 102008029094 | A1 | 1/2009 |
| SI | 23042 | A | 10/2010 |
| WO | 2012128729 | A1 | 9/2012 |

* cited by examiner

ARRESTER FOR PROTECTION AGAINST OVERVOLTAGES

CROSS-REFERENCE TO RELATED APPLICATIONS

This patent application is a national phase filing under section 371 of PCT/EP2018/061833, filed May 8, 2018, which claims the priority of German patent application 10 2017 115 030.7, filed Jul. 5, 2017, each of which is incorporated herein by reference in its entirety.

TECHNICAL FIELD

An arrester for protection against overvoltages is described.

BACKGROUND

A surge arrester—arrester for short—serves for limiting dangerous or undesirable overvoltages in electrical lines and devices. By this means, damage to the lines and devices due to overvoltage can be avoided. Gas-filled arresters, which are also designated as gas-discharge arresters, are arresters in which the overvoltage in the gas-discharge arrester is reduced by the automatic igniting of a gas discharge. Such arresters operate by the gas-physics principle of arc discharge, whereby after an arrester response voltage—designated for short as response voltage or as ignition voltage—has been attained an arc forms in the gas-tight discharge chamber within nanoseconds. By virtue of the high current-carrying capacity of the arc, the overvoltage is effectively short-circuited.

In conventional gas-discharge arresters with two electrodes, a vapor deposition of conducting electrode material on the ceramic inner wall may occur. This leads to a reduction of the insulation resistance of the arrester. Furthermore, impermissibly high leakage currents can be brought about as a result in the course of operation at the rated AC voltage.

German Application No. DE 10 2008 029 094 A1 describes an arrester with an undercut ceramic. By this means, the ceramic inner wall is intended to be protected better.

SUMMARY

Embodiments provide an arrester for protection against overvoltages that exhibits improved properties. For instance, an arrester is to be specified that is particularly reliable, compact and/or durable.

According to one aspect, an arrester for protection against overvoltages is specified. The arrester exhibits a housing. The housing is designed to receive further components of the arrester in an inner region of the housing. The housing may, for instance, have been designed in the form of a hollow cylinder. The housing has further been designed to act as an external electrode. The housing features an electrically conductive material, for instance copper.

The arrester further exhibits a central electrode or internal electrode. The central electrode is arranged completely within an inner region of the housing. A discharge region is formed between the central electrode and the housing. In other words, an arc discharge takes place between the central electrode and the housing in the case of an overvoltage. The central electrode has, for instance, been designed in the form of a cylinder. The central electrode features an electrically conductive material, for instance tungsten and/or copper.

The arrester further includes a ceramic body. The ceramic body serves for insulation. In particular, the ceramic body is designed and arranged for the purpose of electrical separation of the housing and the central electrode. The ceramic body is preferentially in direct mechanical contact with the housing. Preferentially, a direct mechanical contact between the ceramic body and the central electrode is prevented, preferentially by the housing. The ceramic body is arranged in offset manner relative to the discharge chamber.

The electrical separation of the central electrode and the housing occurs in the coaxial direction, the ceramic body being arranged as insulator between the central electrode and the housing. As a result, the ceramic as spacer between the electrodes of the arrester is dispensed with. In particular, the external electrode becomes the body/housing of the arrester. By this means, the outside diameter of the arrester is reduced. Furthermore, an inner wall of the ceramic body is optimally protected against a vapor deposition of electrode material. Hence high leakage currents in the course of operation at the rated AC voltage can be avoided.

The arrester further includes a shielding element. The shielding element is designed and arranged to protect the housing against thermal loading. The shielding element is constituted by a cladding of at least one partial region of an inside of the housing. The shielding element is arranged on the inside of the housing. The shielding element has been firmly connected to the housing, for instance by means of brazing or press fit. The shielding element has an extent along a longitudinal axis of the arrester. Furthermore, the central electrode also has an extent along the longitudinal axis of the arrester—that is to say, a longitudinal extent. The shielding element extends over an entire longitudinal extent of the central electrode along the inside of the housing. In this way, the housing can be efficiently protected against thermal loading. In an alternative embodiment, the shielding element may also extend at least partly perpendicular to the longitudinal axis of the arrester. Hence a front side of the inner region of the housing can also be protected against thermal loading/fusion.

By virtue of the arrangement described above, an arrester is made available that is not only particularly efficient and durable but also has a small outside diameter.

According to one embodiment, the arrester exhibits a coupling element. The coupling element is designed and arranged to contact the central electrode electrically. The coupling element features copper, for instance. The ceramic body exhibits an aperture. The aperture penetrates the ceramic body preferentially completely in a central region of the ceramic body. The coupling element is designed and arranged to extend at least partly through the aperture into the inner region of the housing.

In particular, the coupling element exhibits a connection region. The connection region is elongated or pin-shaped. The connection region is designed to be connected to the central electrode. The connection region extends through the aperture. The coupling element, in particular the connection region, has been soldered to the central electrode.

The coupling element further exhibits an end region. The end region projects out of the housing and the ceramic body. In particular, the end region does not extend through the aperture. The end region is designed to be connected to a further electronic component or to an electronic device. The end region exhibits a screw thread, for instance an M8 screw.

The coupling element further exhibits a central region. The central region is formed between the end region and the connection region. The coupling element has preferentially been formed in one piece. In other words, the connection region, the central region and the end region merge directly with one another.

The coupling element has been connected—for instance, soldered—to the ceramic body via the central region. The central region is plate-shaped or disk-shaped. The central region has a larger diameter than the connection region. The central region has a larger diameter than the end region. The end region has a larger diameter than the connection region.

According to one embodiment, the arrester exhibits a ceramic element. The ceramic element serves as insulator. In particular, the ceramic element is designed and arranged to shield the ceramic body from the discharge chamber even better. Hence the efficiency and durability of the arrester are enhanced.

The ceramic element is of annular design, for instance. For instance, the ceramic element exhibits a ceramic disk with an aperture. The aperture serves for feeding the coupling element through. The ceramic element is formed between the ceramic body and the central electrode. The ceramic element is spaced from the central electrode. The ceramic element has been fastened—for example, soldered—to the shielding element. The ceramic element—for instance, a circumferential edge region of the ceramic element—preferentially rests directly on a partial region of the inside of the housing.

The ceramic element exhibits a step or elevation. The step has preferentially been formed circumferentially on a surface of the ceramic element. The step or elevation preferentially arises from an outer surface of the ceramic element facing toward the central electrode. By virtue of the step, surface-leakage currents after loading are reduced.

According to one embodiment, the arrester exhibits an ignition aid. By virtue of the ignition aid, the dynamic response voltage of the arrester is reduced. As a result, a very efficient arrester is made available. The ignition aid exhibits graphite strips, for instance. The ignition aid is preferentially arranged on the ceramic body. For instance, the ignition aid is formed on an inner wall of the aperture of the ceramic body. The ignition aid is arranged parallel to a longitudinal axis of the arrester. By virtue of the arrangement parallel to the longitudinal axis, a charge difference on the end regions of the ignition aid can be obtained.

According to one embodiment, the ceramic body exhibits an end region facing away from the central electrode. The end region is arranged outside the housing. A gradation is formed on the end region. The gradation is formed circumferentially around an edge region of the aperture. By virtue of the gradation, the insulation resistance of the arrester is improved.

What has been described above will be elucidated in more detail in the following with reference to embodiments.

BRIEF DESCRIPTION OF THE DRAWINGS

The drawings described below are not to be interpreted as being true to scale; rather, in individual dimensions the representations may have been represented in enlarged, reduced or even distorted manner.

DETAILED DESCRIPTION OF ILLUSTRATIVE EMBODIMENTS

Figure 1A:
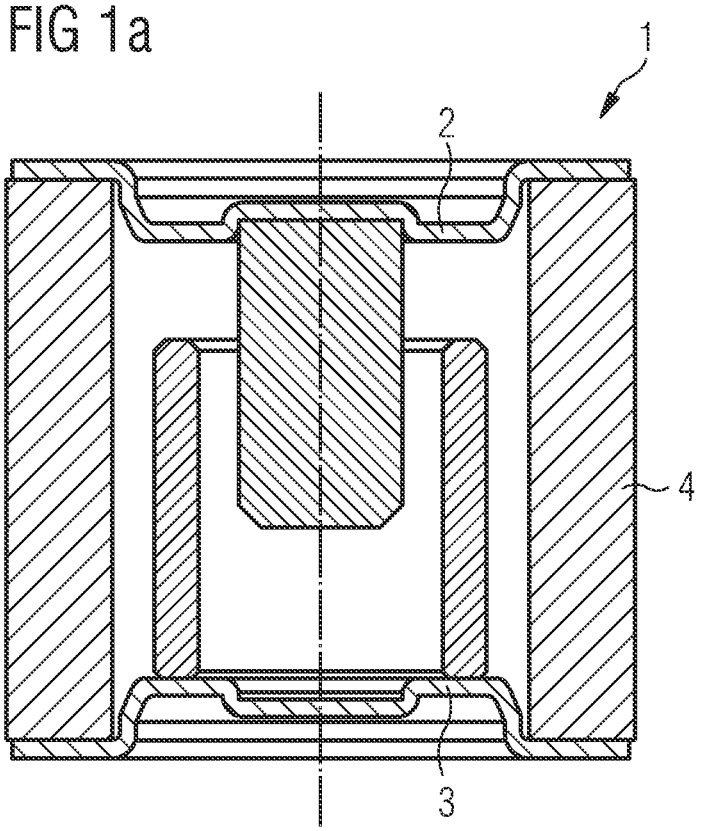
FIG. 1*a* shows a sectional representation of an arrester for protection against overvoltages, according to the state of the art.
Figure 1B:
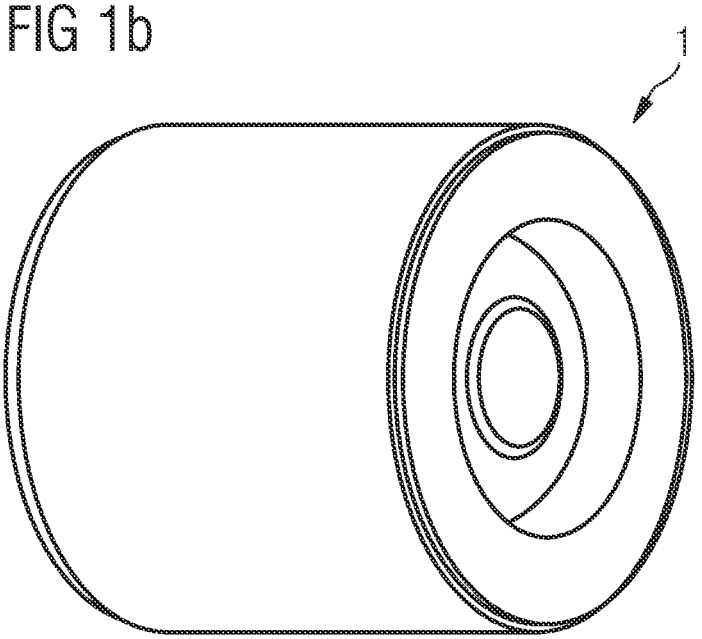
FIG. 1*b* shows a perspectival view of the arrester according to FIG. 1*a;*
Figure 2A:
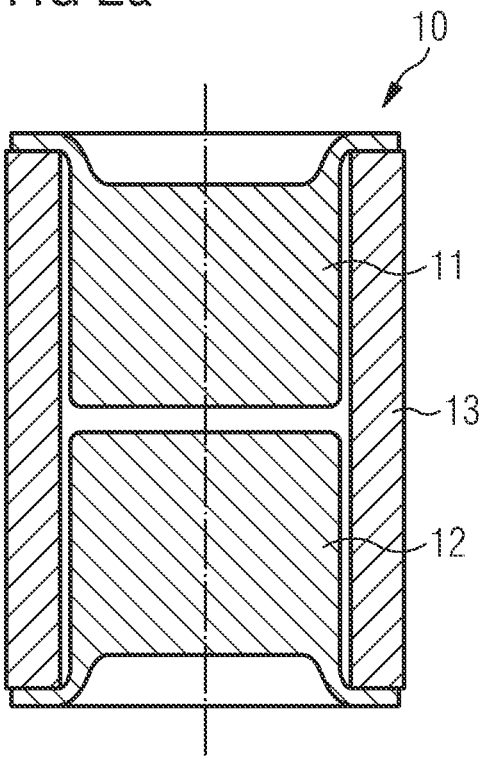
FIG. 2*a* shows a sectional representation of an arrester for protection against overvoltages, according to the state of the art.
Figure 2B:
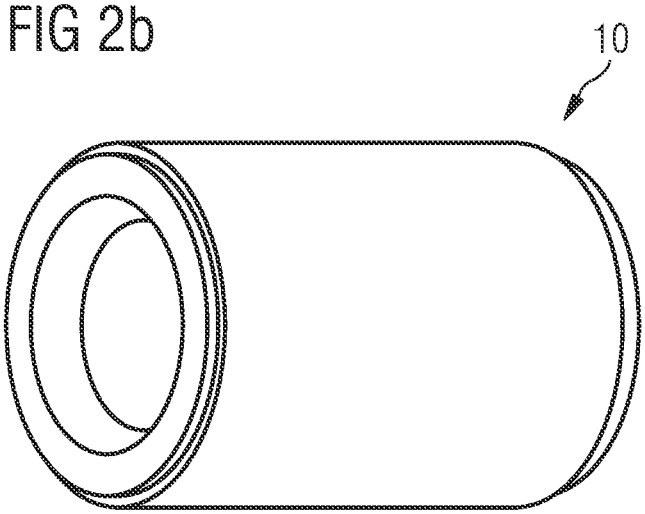
FIG. 2*b* shows a perspectival view of the arrester according to FIG. 2*a;*

FIGS. 1*a*, 1*b*, 2*a* and 2*b* show arresters 1, 10 for protection against overvoltages, according to the state of the art. The arresters 1, 10 represented in FIGS. 1*b* and 2*b* are to be regarded as being true to scale.

The conventional structural design of surge arresters includes two electrodes 2, 3 (FIG. 1*a*) or 11, 12 (FIG. 2*a*) which are positioned either coaxially or against one another. Furthermore, in each instance a ceramic body 4, 13 is provided as insulator or spacer between the electrodes.

At high current loads (for example, wave 10/350 μs, currents up to 100 kA), a vapor deposition of conducting electrode material occurs on an inner wall of the ceramic body 4, 13. This leads to a reduction of the insulation resistance of the arrester 1, 10. Under certain circumstances, impermissibly high leakage currents arise as a result in the course of operation at rated AC voltage.

Figure 3A:
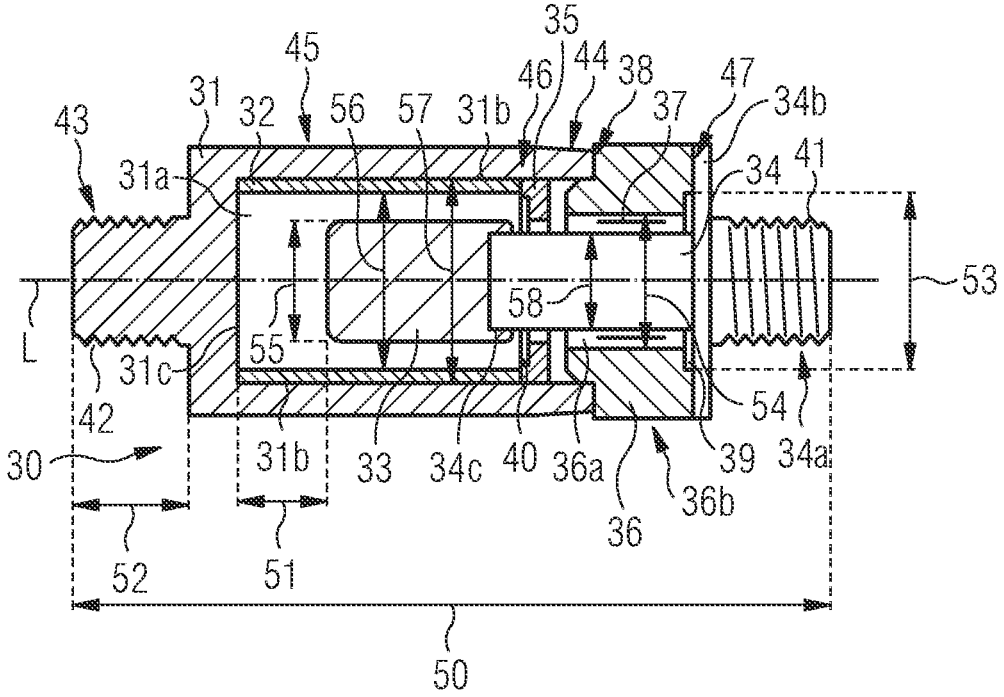
FIG. 3*a* shows a sectional representation of an arrester for protection against overvoltages.
Figure 3B:
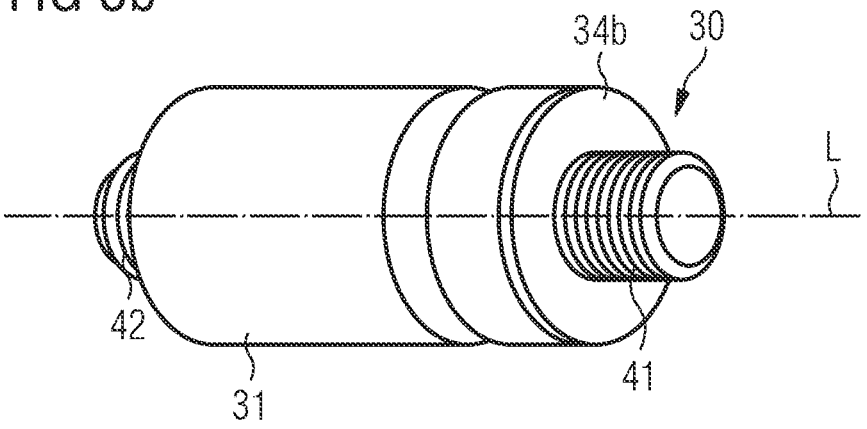
FIG. 3*b* shows a perspectival view of the arrester according to FIG. 3*a.*

The arrester 30 described in connection with FIGS. 3*a* and 3*b* solves the problems described above by exhibiting a better protection of the ceramic inner wall and an improvement of the insulation resistance after loading.

The arrester 30 exhibits a housing 31. The housing 31 serves for receiving further components of the arrester 30. At the same time, the housing also acts as an external electrode. The housing 31 preferentially features copper.

In a first end region 43 the housing 31 exhibits a coupling element 42, for instance a screw thread. The coupling element 42 has a length 52 of less than or equal to 8 mm, for instance 7 mm.

The housing 31 further exhibits a central region 45. The central region 45 serves for receiving a central electrode 33 or internal electrode, as will be described in detail later. The housing 31 further exhibits a second end region 44. The second end region 44 serves for connecting the housing 31 to an insulator or ceramic body 36, as will be described in detail later.

The first and second end regions 43, 44 each directly adjoin the central region 45. In particular, the housing 31 has preferentially been formed in one piece. The first end region 43 has a diameter that is smaller than a diameter of the central region 45 and of the second end region 44. The diameter of the second end region 44 is furthermore smaller than the diameter of the central region 45. The diameter of the central region 45 of the housing 31 is preferentially less than or equal to 20 mm, for instance 16.8 mm.

An outer surface of the central region 45 extends parallel to a longitudinal axis L of the arrester 30. An outer surface of the second end region 44, on the other hand, includes an angle with the longitudinal axis L. In other words, the second end region 44 is formed obliquely.

The housing 31 exhibits an inner region 31*a*. The central electrode 33 is arranged in the inner region 31*a*. The inner region 31*a* forms a discharge chamber between the housing or the external electrode 31 and the central electrode 33. The inner region 31*a* has a diameter 57 that is preferentially less than or equal to 15 mm, for instance 12 mm or 13 mm.

The central electrode 33 preferentially features tungsten-copper. The central electrode 33 has a diameter 55 of less than or equal to 10 mm, for instance 7.5 mm. The central electrode 33 has for instance been designed to be cylindrical.

The central electrode 33 is spaced from an inside or inner longitudinal side 31*b* and from an inner front side 31*c* of the housing 31. The inside 31*b* and front side 31*c* together constitute a wall of the inner region 31*a* of the housing 31.

The spacing between the central electrode 33 and the inside 31*b* or front side 31*c* preferentially amounts to up to 6 mm. A spacing 51 between a front side of the central electrode 33 and front side 31*c* amounts, for instance, to 5.5 mm or less.

The arrester 30 further exhibits a shielding element 32. The shielding element 32 serves to enhance the performance of the external electrode 31. In particular, the shielding element 32 protects the housing or the external electrode 31 against thermal loading. The shielding element 32 preferentially features tungsten-copper.

The shielding element 32 is formed in the inner region 31*a* of the housing 31. The shielding element 32 consequently reduces the diameter 57 of the inner region 31*a*. A diameter 56 of the inner region 31*a* reduced by the shielding element 32 preferentially amounts to less than or equal to 12 mm, for instance 11 mm. A thickness or radial extent (extent at right angles to the longitudinal axis L) of the shielding element 32 amounts to less than or equal to 2 mm. The shielding element 32 has been firmly connected to the housing 31, for instance by brazing or press fit.

The shielding element 32 extends on the inside 31*b* of the housing 31 along the longitudinal axis L of the arrester 30. A length of the shielding element 32 is such that the shielding element 32 extends along a complete length of the central electrode 33. In other words, a longitudinal extent of the shielding element 32 is greater than a longitudinal extent of the central electrode 33. In particular, the shielding element 32 extends along the complete inside 31*b* of the housing 31. For instance, the length of the shielding element 32 amounts to up to 20 mm, for instance 17 mm. An overall length 50 of the arrester 30 preferentially amounts to less than or equal to 50 mm, for instance 46 mm or 47 mm. In addition, the shielding element 32 may also extend at least partly on the inner front side 31*c* of the housing 31 (not represented explicitly).

The arrester 30 further exhibits the ceramic body or insulator 36. The arrester 30 exhibits a coupling element 34.

The ceramic body 36 serves for electrical insulation of the housing 31 and of the central electrode 33. The ceramic body 36 is arranged in the second end region 44 of the housing 31. The ceramic body 36 is consequently arranged in a manner offset from the discharge chamber which is formed between the housing 31 and the central electrode 33. Hence an insulating body directly between the housing or external electrode 31 and the central electrode 33 is dispensed with. Hence an outside diameter of the arrester 30 is reduced. For instance, the outside diameter of the arrester 30 amounts to less than or equal to 20 mm, for instance 17 mm (see also FIG. 3*b*, which is to be understood as a true-to-scale representation of an embodiment of the arrester 30).

The ceramic body 36 exhibits a central aperture 36*a*. The aperture 36*a* has a diameter 54 of less than or equal to 10 mm, for instance 8.5 mm. The aperture 36*a* serves for feeding the coupling element 34 through into the inner region 31*a*. The coupling element 34 will be described in detail later.

The ceramic body 36 is firmly connected to the housing 31. For instance, the ceramic body 36 and the housing 31 have been soldered together. The ceramic body 36 has been soldered to the housing 31, in particular in a soldering region 38 in the end region 44 of the housing 31.

For this purpose, the ceramic body 36 exhibits a specially shaped first end region. The first end region faces toward the housing 31. The first end region exhibits a step. The step is formed circumferentially. The step serves as stop surface for the end region 44, and also as soldering region 38.

The ceramic body 36 further exhibits a second end region 36*b*. The second end region 36*b* faces away from the housing 31. The second end region 36*b* exhibits a gradation or undercut 39. The gradation 39 is formed circumferentially around the aperture 36. In other words, the gradation 39 is constituted by a bulge of the ceramic body 36, in particular of a front face of the ceramic body 36, that is formed directly adjacent to the aperture 36. The gradation 39 extends outward in the radial direction from lateral edges of the aperture 36*a*. The gradation 39 has a diameter 53 of less than or equal to 13 mm, for instance 11 mm. The gradation 39 serves to reduce surface-leakage currents after loading of the arrester 30.

The coupling element 34 is pin-shaped. The coupling element 34 has been firmly connected—for instance, soldered—to the central electrode 33. In particular, the coupling element 34 has been soldered to the electrode 33 in a connection region or end region 34*c*. In this way, the central electrode 33 becomes more resistant to the thermal loading arising during the discharge. The coupling element 34 features copper, for instance. The coupling element 34, in particular the connection region 34*c*, has a diameter 58 of less than or equal to 8 mm, for instance 6 mm. For the electrical contacting of the central electrode 33, the coupling element 34, in particular the connection region 34*c*, has been passed through the aperture 36 and into the inner region 31*a*.

The coupling element 34 exhibits an end region 34*a* which protrudes from the ceramic body 36. On the end region 34*a* a screw thread 41, for instance an M8 screw, is formed. A diameter of the end region 34*a* is larger than the diameter 58 of the connection region 34*c*.

The coupling element 34 has been firmly connected to the ceramic body 36, for instance by means of brazing. For this purpose, the coupling element 34 exhibits a widened central region 34*b*. A diameter of the central region 34*b* is larger than the diameter 58 of the connection region 34*c* and larger than the diameter of the end region 34*a*. The central region 34*b* is disk-shaped. The central region 34*b* directly adjoins the end region 34*a*. In particular, the central region 34*b* is arranged between the end region 34*a* and the connection region 34*c*. The central region 34*b* rests, at least in a partial region, directly on the ceramic body 36, in particular on a front face of the ceramic body 36.

Between the front face of the ceramic body 36 and an upper side of the central region 34*b*, in particular an annular outer region of the upper side, a soldering region 47 is formed for soldering the coupling element 34 and the ceramic body 36 together.

In this embodiment, the arrester 30 further exhibits a ceramic element 35, but embodiments without a ceramic element 35 are also conceivable. The ceramic element 35 is annular. In particular, the ceramic element 35 exhibits an aperture for feeding the coupling element 34 through.

The ceramic element 35 is arranged in the inner region 31*a*. In particular, the ceramic element 35 seals or bounds the inner region 31*a* of the housing in the direction of the ceramic body 36. The ceramic element 35 rests in a lateral region directly on the housing 31, in particular on the inside 31*b* thereof. The ceramic element 35 is arranged in the longitudinal direction of the arrester 30 between the shielding element 32 and the ceramic body 36.

The ceramic element 35 improves the shielding of the ceramic body 36 relative to the discharge chamber which is located between the housing 31 and the central electrode 33. The ceramic element 35 preferentially exhibits a step or elevation 40. The step 40 is formed circumferentially on an outer surface of the ceramic element 35, for instance on a surface of the ceramic element 35 facing toward the shielding element 32. The step 40 is designed to reduce surface-leakage currents after loading.

The ceramic element 35 has been soldered to the shielding element 32, for instance by means of brazing. For this purpose, a soldering region 46 is formed between the shielding element 32 and the ceramic element 35, in particular the step 40.

The arrester 30 further exhibits an ignition aid 37. The ignition aid 37 may exhibit a graphite strip or a plurality of graphite strips. The ignition aid 37 extends parallel to the longitudinal axis L of the arrester 30.

The ignition aid is arranged on an inner wall of the ceramic body 36. In particular, the ignition aid 37 is formed in the region of the aperture 36*a* and, in particular, in the region of the side walls of the aperture 36*a*. The ignition aid 37 serves to reduce the response voltage of the arrester 30.

The description of the subject-matters specified herein is not limited to the individual special practical forms. Rather, the features of the individual practical forms can—to the extent that this is technically meaningful—be combined arbitrarily with one another.

The invention claimed is:

1. An arrester comprising:

a housing configured to act as an external electrode;

a central electrode arranged completely within an inner region of the housing;

a discharge region arranged between the central electrode and the housing;

a ceramic body separating the housing and the central electrode;

wherein the ceramic body is arranged in an offset manner relative to the discharge region; and a shielding element arranged on an inside of the housing, wherein the shielding element extends over an entire longitudinal extent of the central electrode along the inside of the housing.

2. The arrester according to claim 1, further comprising a coupling element, wherein the ceramic body comprises an aperture, and wherein the coupling element passes through the aperture into the inner region of the housing.

3. The arrester according to claim 2, wherein the coupling element is soldered to the central electrode.

4. The arrester according to claim 2, wherein the coupling element comprises an end region which protrudes from the housing and from the ceramic body, and wherein the end region comprises a screw thread.

5. The arrester according to claim 2, wherein the coupling element comprises a central region, wherein the central region has a larger diameter than a connection region via which the coupling element is connected to the central electrode, and wherein the coupling element is connected to the ceramic body via the central region.

6. The arrester according to claim 2, further comprising an ignition aid, wherein the ignition aid is formed on an inner wall of the aperture of the ceramic body.

7. The arrester according to claim 6, wherein the ignition aid is arranged parallel to a longitudinal axis of the arrester.

8. The arrester according to claim 6, wherein the ignition aid comprises graphite strips.

9. The arrester according to claim 1, further comprising a ceramic element, wherein the ceramic element is arranged between the ceramic body and the central electrode.

10. The arrester according to claim 9, wherein the ceramic element is spaced from the central electrode and fastened to the shielding element.

11. The arrester according to claim 9, wherein the ceramic element rests directly on a partial region of the inside of the housing.

12. The arrester according to claim 9, wherein the ceramic element has a step, wherein the step is formed circumferentially on a surface of the ceramic element.

13. The arrester according to claim 1, wherein the ceramic body comprises an end region facing away from the central electrode, wherein the end region is arranged outside the housing, and wherein a gradation is formed on the end region.

14. The arrester according to claim 13, wherein the gradation is formed circumferentially around an edge region of an aperture.

15. An arrester comprising:

a housing configured to act as an external electrode;

a central electrode arranged completely within an inner region of the housing;

a discharge region arranged between the central electrode and the housing;

a ceramic body separating the housing and the central electrode, wherein the ceramic body is arranged in an offset manner relative to the discharge region;

a shielding element, wherein the shielding element is arranged on an inside of the housing, and wherein the shielding element extends over an entire longitudinal extent of the central electrode along the inside of the housing; and a ceramic element, wherein the ceramic element is located between the ceramic body and the central electrode, and wherein the ceramic element is fastened to the shielding element.

* * * * *